US005160087A

United States Patent [19]

Mandell

[11] Patent Number: 5,160,087

[45] Date of Patent: Nov. 3, 1992

[54] DRINKING STRAW

[76] Inventor: Gerald D. Mandell, P.O. Box 583, Ashland, Oreg. 97520

[21] Appl. No.: 724,117

[22] Filed: Jul. 1, 1991

[51] Int. Cl.[5] ..... A47G 21/18

[52] U.S. Cl. ..... 239/33; 446/202; 446/475

[58] Field of Search ..... 239/16, 24, 33; 446/202, 200, 475

[56] References Cited

U.S. PATENT DOCUMENTS

| | | | |
|---|---|---|---|
| D. 199,661 | 12/1964 | Rosen | D2/3 |
| 1,151,869 | 8/1915 | Freeburg | 239/33 X |
| 2,558,645 | 6/1951 | Docter | 65/65 |
| 2,948,476 | 8/1960 | Don | 239/24 |
| 3,260,460 | 7/1966 | Smaczny | 239/33 |
| 3,729,136 | 4/1973 | Friedman | 239/33 |
| 4,462,544 | 7/1984 | Rutzel et al. | 239/33 |
| 4,699,318 | 10/1987 | Donatello et al. | 239/33 |

FOREIGN PATENT DOCUMENTS

| | | | |
|---|---|---|---|
| 1292318 | 4/1969 | Fed. Rep. of Germany | 239/33 |

*Primary Examiner*—Andres Kashnikow

*Assistant Examiner*—William Grant

*Attorney, Agent, or Firm*—John F. Ingman

[57] ABSTRACT

A drinking straw, designed to demonstrate the need for teamwork, which includes a hollow chamber to which is connected, at its lower end, a tubular inlet member which extends downwardly so as to form a passage for flow of liquid from a reservoir into the hollow chamber. At or proximate the upper part of the hollow chamber are connected a plurality of tubular outlet mouthpiece members, normally two for a basic "love straw" configuration, which extend outwardly therefrom so as to form passages for the flow of liquid from the hollow chamber. The hollow chamber has an internal volume of at least five cubic centimeters, a preferred volume of approximately twenty cubic centimeters, and is formed in the shape of a heart. The hollow chamber may be formed to be separable into two or more sections to facilitate cleaning of the interior of the chamber. The tubular inlet member and the tubular outlet mouthpiece members may be separable from the hollow chamber. In addition, the hollow chamber, tubular inlet member and tubular outlet mouthpiece members may be made of a transparent material.

10 Claims, 1 Drawing Sheet

DRINKING STRAW

BACKGROUND OF THE INVENTION

1. Field of the Invention

This invention is a new drinking straw, and, more particularly, a straw having a plurality of tubular outlet mouthpieces attached to a hollow chamber which in turn is attached to a tubular inlet, and a method for demonstrating the requirement for teamwork by those using this invention.

2. Description of the Prior Art

Drinking straws have been designed in different forms for various purposes. U.S. Pat. No. 2,558,645 and U.S. Pat. No. Des. 199,661 show drinking straw devices which enable two or more persons to drink from a single reservoir, but each drinker draws from separate tubes submerged in the liquid. U.S. Pat. No. 3,729,136 provides a device which appears, through illusion, as if two persons, more precisely one person and a doll, are drinking from the same source. U.S. Pat. No. 3,260,460 describes a drinking tube device which allows one person to drink from two reservoirs at the same time. Certain configurations of this device provide a chamber which creates a mixing action as the liquids from the two reservoirs are drawn up through a single mouthpiece tube. These prior art patents do not describe a drinking straw which requires the simultaneous use by two or more parties.

The importance of teamwork, as required in marriage, family, business or other close relationships, may be demonstrated by the use of a drinking straw which is designed so that one person cannot easily drink alone, but that two persons, applying suction simultaneously, can work as a team to successfully draw liquid from a reservoir. If, in this action, one party ceases to cooperate as a team member, the other party's ability to draw liquid would be ended. Such a device, used by two persons, could be termed a "love straw". A family "love straw" requiring the cooperation of more than two participants would, in the same manner, teach teamwork within a family or a group framework.

SUMMARY OF THE INVENTION

The present invention involves a drinking straw which has been designed to demonstrate the need for teamwork.

Accordingly, in the preferred embodiment, the drinking straw includes a hollow chamber to which is connected, at its lower end, a tubular inlet member which extends downwardly so as to form a passage for flow of liquid from a reservoir into the hollow chamber. At or proximate the upper part of the hollow chamber are connected a plurality of tubular outlet mouthpiece members, normally two for a basic "love straw" configuration, which extend outwardly therefrom so as to form passages for the flow of liquid from the hollow chamber. Such configuration of an appropriately sized hollow chamber, the tubular inlet member and the tubular outlet mouthpiece members will prevent one person from easily "drinking alone" through the described device. The hollow chamber has an internal volume of at least five cubic centimeters, a preferred volume of approximately twenty cubic centimeters, and is formed in the shape of a heart.

The hollow chamber may be formed to be separable into two or more sections to facilitate cleaning of the interior of the chamber. The tubular inlet member and the tubular outlet mouthpiece members may be separable from the hollow chamber. In addition, the hollow chamber, tubular inlet member and tubular outlet mouthpiece members may be made of a transparent material.

DESCRIPTION OF THE PREFERRED EMBODIMENT

Figure 1:
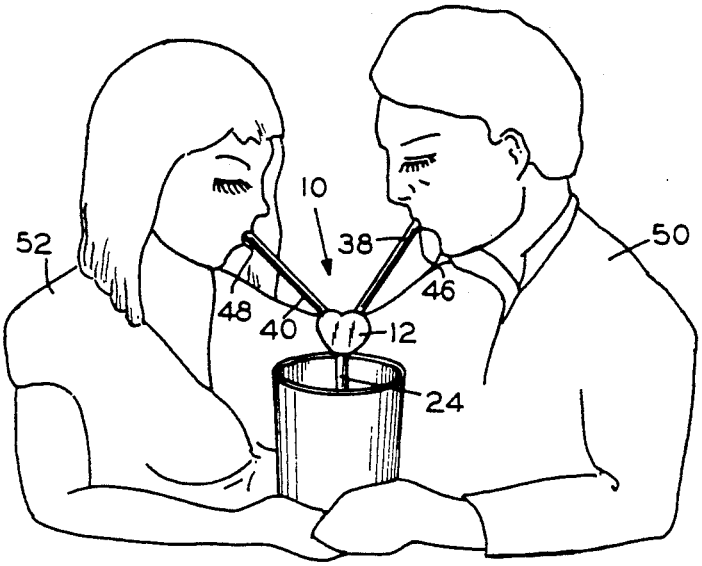
FIG. 1 illustrates a front elevational view of the drinking straw in use.

Turning now to the drawings, there is shown the preferred embodiment of the drinking straw 10. A hollow chamber 12, preferably, but not necessarily, shaped as a heart 14 to evoke sentiments of romance, includes a hollow interior 16. An aperture 18 is formed through the wall 20 at the lower portion 22 of the chamber 12 to which is joined a tubular inlet member 24, so that a passage 26 is formed for the flow of liquid 28 into the chamber 12 from a reservoir 30. Two additional apertures 32 and 34 are formed through wall 20 at the upper portion 36 of hollow chamber 12 to which are joined, respectively, two tubular outlet mouthpiece members 38 and 40, so that passages 42 and 44 are formed for the flow of liquid 28 from the hollow chamber 12 into the mouths 46 and 48 of the users 50 and 52.

The hollow chamber 12 may vary in internal volume relative to the diameter of the inlet member 24 and outlet mouthpiece members 38 and 40. A hollow chamber 12, when utilized with an inlet member 24 and outlet mouthpiece members 38 and 40 having a standard inside diameter of approximately 0.235-inches, should have an internal volume of at least five cubic centimeters. At a volume of less than five cubic centimeters, one person alone may be able to reduce the air pressure within the hollow chamber 12 sufficiently to gain some liquid 28. A preferred volume is approximately twenty cubic centimeters, which is comfortably within the capability of a co-operating couple.

When both users 50 and 52 are applying suction in concert to tubular outlet members 38 and 40, the air pressure therein, and in hollow chamber 12 and the tubular inlet member 24, is reduced to the extent that liquid 28 within the reservoir 30 is easily drawn up through the respective tubular outlet mouthpiece members 38 and 40 into both mouths 46 and 48. However, if one user, say 50, removes his mouth 46 from tubular outlet mouthpiece member 38, the other user 52, is faced with an open system at tubular outlet mouthpiece member 38. Suction by user 52 at tubular outlet mouthpiece member 40 will cause air to rush through tubular outlet mouthpiece member 38 into the hollow chamber 12 in response to user 52's suction, thereby drastically reducing and limiting the reduction in air pressure within the hollow chamber 12. While some reduction in air pressure within the hollow chamber 12 due to the efforts of user 52 will occur, the reduction will be insufficient for user 52 to easily draw the liquid 28 above the height 54 of the hollow chamber 12 and into the mouth 48 of the solitary user 52. Thus, a lack of teamwork between users 50 and 52 results in neither being able to drink.

The tubular inlet member 24 and the tubular outlet mouthpiece members 38 and 40 may be formed integrally with the hollow chamber 12, or may be formed separately and subsequently joined to the hollow chamber 12. The tubular inlet member 24 and the tubular outlet mouth piece members 38 and 40 preferably are cylindrical in shape, but are not so limited, other shapes such as octaganal or square being clearly within the scope of the invention.

Figure 4:
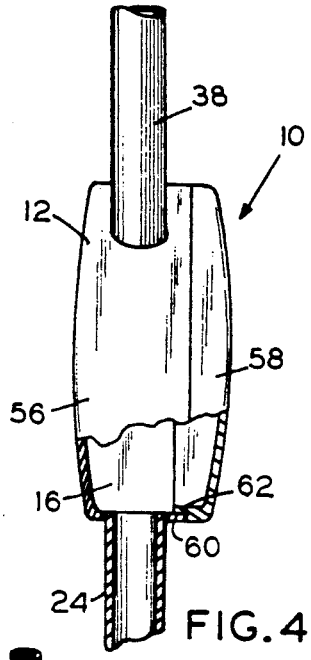
FIG. 4 illustrates a side elevational view of an alternative configuration of the drinking straw, wherein the hollow chamber is separable into two parts.

FIG. 4 illustrates an alternative configuration of the drinking straw 10 wherein the hollow chamber 12 is separable into two components, a base 56 and a cover 58. The removable cover 58 permits the hollow chamber 12 to be readily cleaned. The base 56 and the cover 58 are formed to provide an essentially air-tight closure when joined, as by an overlapping lip 60 of the base engaging a perimeter lip 62 in the cover 58. If desired, cover 58 can be joined to base 56 by a hinge (not shown). The hollow chamber 12 may, of course, be formed of a greater number of components, as desired.

Figure 2:
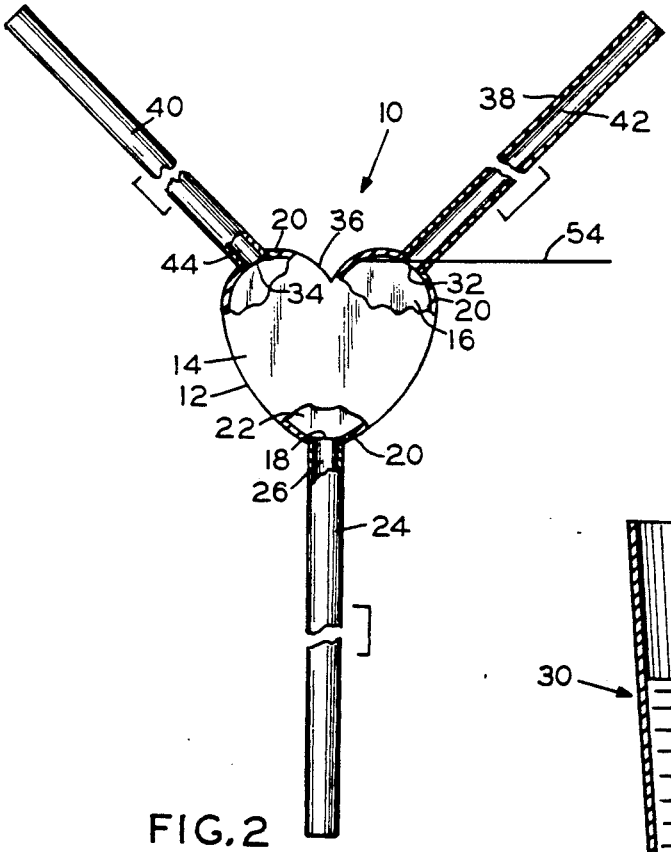
FIG. 2 illustrates an front elevational view of the drinking straw.
Figure 3:
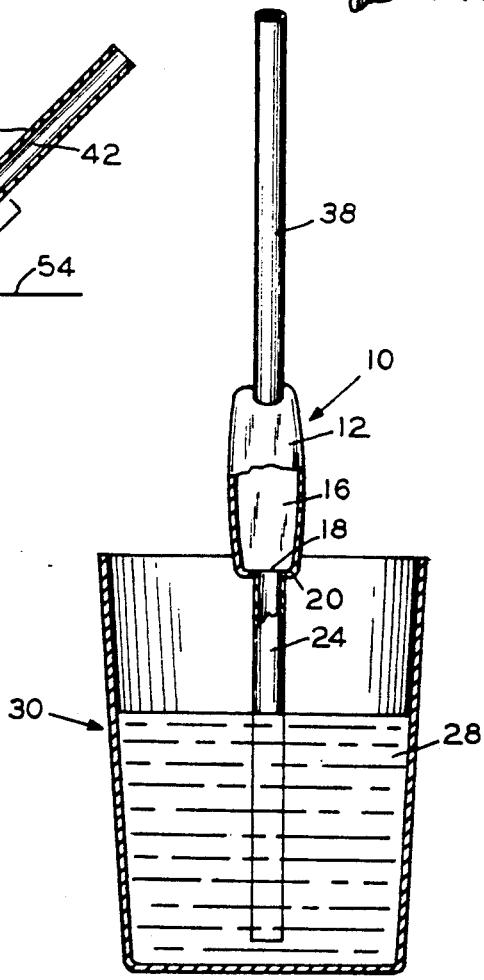
FIG. 3 illustrates a side elevational view of the drinking straw inserted in a reservoir of liquid.

The heart shape 14 of the hollow chamber 12, best seen in FIG. 2 is the preferred embodiment of this device. However, for aesthetic, promotional, or other reasons, other shapes of hollow chamber 12 may be used.

It is thought that the drinking straw 10 of the present invention and its many attendant advantages will be understood from the foregoing description and that it will be apparent that various changes may be made in form, construction and arrangement of the parts thereof without departing from the spirit and scope of the invention or sacrificing all of its material advantages, the forms hereinbefore stated being merely exemplary embodiments thereof.

I claim:

1. A drinking straw, comprising:

a. a hollow chamber;

b. a tubular inlet member connected to said hollow chamber and extending downwardly so as to form a passage for flow of liquid into said hollow chamber;

c. a plurality of tubular outlet mouthpiece members connected to said hollow chamber and extending outwardly therefrom so as to form passages for the flow of liquid from said hollow chamber; and d. means for producing a partial vacuum simultaneously in each of said plurality of tubular outlet mouthpiece members;

e. said partial vacuum simultaneously produced in said tubular outlet mouthpiece members creating a partial vacuum in said hollow chamber which is sufficient to draw liquid into said hollow chamber through said tubular inlet member so that said liquid enters into each of said plurality of tubular outlet mouthpiece members, thereby allowing liquid to be drawn by said simultaneous partial vacuum through said tubular outlet mouthpiece members.

2. The drinking straw, as recited in claim 1, wherein the tubular inlet member is connected proximate a lower portion of said hollow chamber and the plurality of tubular outlet mouthpiece members each are connected proximate an upper portion of said hollow chamber.

3. The drinking straw, as recited in claim 1, wherein the hollow chamber is heart shaped.

4. The drinking straw, as recited in claim 1, wherein the hollow chamber is formed of at least two parts which are mutually separable.

5. The drinking straw, as recited in claim 1, wherein the hollow chamber is formed of a transparent material.

6. The drinking straw, as recited in claim 1, wherein the tubular inlet member and the tubular outlet mouthpiece members are separable from the hollow chamber.

7. The drinking straw, as recited in claim 1, wherein the internal volume of the hollow chamber is at least five cubic centimeters.

8. The drinking straw, as recited in claim 1, wherein the internal volume of the hollow chamber is approximately twenty cubic centimeters.

9. A drinking straw apparatus, for use in demonstrating the importance of teamwork between a plurality of users, comprising:

a. a hollow chamber;

b. a tubular inlet member connected to said hollow chamber and extending downwardly so as to form a passage for flow of liquid from a reservoir of liquid into said hollow chamber;

c. a plurality of tubular outlet mouthpiece members connected to said hollow chamber and extending outwardly therefrom, each tubular outlet mouthpiece member forming a passage for the flow of liquid from said hollow chamber to a user; and d. a partial vacuum simultaneously produced in each of said plurality of tubular outlet mouthpiece members by said plurality of users;

e. said partial vacuums simultaneously produced in said tubular outlet mouthpiece members creating a partial vacuum in said hollow chamber which is sufficient to draw liquid into said hollow chamber through said tubular inlet member so that said liquid enters into each of said plurality of tubular outlet mouthpiece members, thereby allowing liquid to be drawn through said tubular outlet mouthpiece members by said simultaneous partial vacuum in said tubular outlet mouthpiece members.

10. A method for demonstrating the importance of teamwork between a plurality of users, said method comprising the steps of:

a. providing a drinking straw apparatus having a hollow chamber, a tubular inlet member connected to said hollow chamber to form a passage for the flow of liquid into said hollow chamber, and a plurality of tubular outlet mouthpiece members, one for each of the plurality of users, connected to said hollow chamber to form a passage for the flow of liquid from the hollow chamber to each user's mouth;

b. immersing the tubular inlet member into a reservoir of liquid;

c. creating suction simultaneously by all users in their respective tubular outlet mouthpiece members;

d. drawing cooperatively, by continuing simultaneous suction by all users, liquid from said reservoir into said hollow chamber; and e. continuing to draw, by further continuing simultaneous suction by all users, said liquid from within said hollow chamber through each tubular outlet mouthpiece member and into each user's mouth.

* * * * *